US009456960B2

(12) United States Patent
Ginzburg et al.

(10) Patent No.: US 9,456,960 B2
(45) Date of Patent: Oct. 4, 2016

(54) SEMI-RIGID PARTIALLY COLLAPSIBLE BOTTLES

(75) Inventors: Jean-Daniel Ginzburg, Viry (FR); Bjorn Joakim Lindberg, Lausanne (CH); James Scott Teresi, Savigny (CH); Andrea Rigardo, Cavatore (IT)

(73) Assignee: Nestec S.A., Vevey (CH)

( * ) Notice: Subject to any disclaimer, the term of this patent is extended or adjusted under 35 U.S.C. 154(b) by 1267 days.

(21) Appl. No.: 13/140,526

(22) PCT Filed: Dec. 7, 2009

(86) PCT No.: PCT/US2009/066978

§ 371 (c)(1),
(2), (4) Date: Nov. 17, 2011

(87) PCT Pub. No.: WO2010/080280

PCT Pub. Date: Jul. 15, 2010

(65) Prior Publication Data

US 2012/0150140 A1 Jun. 14, 2012

Related U.S. Application Data

(60) Provisional application No. 61/139,021, filed on Dec. 19, 2008.

(51) Int. Cl.

| | |
|---|---|
| ***A61J 9/00*** | (2006.01) |
| ***A61J 1/14*** | (2006.01) |
| ***A61J 15/00*** | (2006.01) |

(52) U.S. Cl.

CPC ..... *A61J 9/005* (2013.01); *A61J 1/1412* (2013.01); *A61J 1/1475* (2013.01); *A61J 1/1418* (2015.05); *A61J 1/1468* (2015.05); *A61J 1/1487* (2015.05); *A61J 15/00* (2013.01)

(58) Field of Classification Search

CPC ..... A61J 9/00; A61J 11/04; A61J 9/005; A61J 1/1412; A61J 1/1475; A61J 1/1418; A61J 1/1468; A61J 1/1487; A61J 15/00

USPC ..... 215/12.1, 11.3, 11.1, 900

See application file for complete search history.

(56) References Cited

U.S. PATENT DOCUMENTS 3,289,874 A * 12/1966 Dailey ..... A61J 9/005 215/11.6

4,722,850 A 2/1988 White et al.

(Continued)

FOREIGN PATENT DOCUMENTS

| | | |
|---|---|---|
| CN | 2054689 | 3/1990 |
| CN | 2600096 | 1/2004 |

(Continued)

OTHER PUBLICATIONS

International Search Report PCT/US2009/066978 mailing date of Mar. 24, 2010—6 pages.

(Continued)

*Primary Examiner* — Emily Schmidt
*Assistant Examiner* — Lauren M Peng
(74) *Attorney, Agent, or Firm* — K&L Gates LLP

(57) ABSTRACT

Partially collapsible bottles (10) for providing nutritional compositions and other fluids and methods of using the partially collapsible bottles are provided. In a general embodiment, the present disclosure provides a bottle (10) having a rigid wall (20), and a semi-rigid wall (30). The semi-rigid wall (30) is constructed and arranged to conform to an inner side of the rigid wall (20) in a collapsed form. The bottle (10) can be sized to hold any suitable volume such as, for example, from about 100 to 5000 mL.

22 Claims, 3 Drawing Sheets

(56) References Cited

U.S. PATENT DOCUMENTS

| | | | | |
|---|---|---|---|---|
| 4,739,906 | A * | 4/1988 | LoTurco | A61J 1/1443 222/212 |
| 8,100,276 | B2 * | 1/2012 | Moor | A61J 9/005 215/11.1 |
| 2004/0060598 | A1 * | 4/2004 | Danby | A45F 3/16 137/508 |

FOREIGN PATENT DOCUMENTS

| | | |
|---|---|---|
| CN | 1972659 | 5/2007 |
| DE | 3906418 | 9/1990 |
| JP | 01158956 | 6/1989 |
| JP | 04-057751 | 2/1992 |
| JP | 04-224757 | 8/1992 |
| JP | 07088150 | 4/1995 |
| JP | 2003341641 | 12/2003 |
| WO | WO 9945885 | 9/1999 |
| WO | 2006026684 | 3/2006 |
| WO | 2007094479 | 8/2007 |
| WO | 2010/080280 | 7/2010 |

OTHER PUBLICATIONS

Japanese Office Action for Application No. P2014-128456, Dispatch No. 218239, dated May 19, 2015, 9 pages.

* cited by examiner

SEMI-RIGID PARTIALLY COLLAPSIBLE BOTTLES

BACKGROUND

The present disclosure generally relates to health and nutrition. More specifically, the present disclosure relates to bottles and methods useful in the storage and delivery of nutritional compositions and other fluids are described.

The delivery of nutritional compositions to mammals, such as human patients, that cannot orally ingest food or other forms of nutrition is often of critical importance. For example, enteral bottles having feeding tubes that deposit food directly into the gastrointestinal tract at a point below the mouth are often used to sustain life while a patient is unable, or refuses, to take food orally. Bottles, feeding tubes and other artificial delivery systems and routes can be used temporarily during the treatment of acute medical conditions. For chronic medical conditions, such systems and routes can be used as part of a treatment regimen that lasts for the remainder of a patient's life. No matter the duration of use, these devices often provide the only means for feeding the patient.

Fluid nutritional compositions, frequently referred to as "formula" are typically stored in feeding container to be administered to patients. The use of conventional rigid formula containers has drawbacks, particularly in the clinical setting. For example, because the act of piercing the container with a spike involves the collection and handling of multiple components, an opportunity to introduce contamination into the nutritional composition is created. In addition, as the formula is administered to the patient, air spaces left in the rigid bottle may provide space for microbes, especially bacteria to collect thereby contaminating the formula and in some cases, reducing hang times of the solution. Considering the direct route the formula will take into the patient, contaminated formula can lead to infection, including serious and difficult to treat nosocomial infections. Contaminated formula can also lead to microbial growth in the feeding tube, necessitating its flushing and/or replacement.

SUMMARY

The present disclosure relates to partially collapsible bottles for providing nutritional compositions and other fluids and methods of using the partially collapsible bottles. In a general embodiment, the present disclosure provides a bottle having a rigid wall and a semi-rigid wall. The semi-rigid wall is constructed and arranged to conform to an inner side of the rigid wall in a collapsed form. The bottle can be sized to hold any suitable volume such as, for example, from about 100 to 5000 mL.

In an embodiment, the semi-rigid wall is collapsible upon an applied pressure ranging from about 15 mBar to about 80 mBar. The semi-rigid wall can be collapsible upon an applied pressure ranging from about 40 mBar to about 60 mBar. In addition, the semi-rigid wall can be collapsible upon an applied pressure ranging from about 45 mBar to about 55 mBar. The semi-rigid wall can also be collapsible upon an applied pressure of about 50 mBar.

In an embodiment, the semi-rigid wall has a surface area greater than or equal to a surface area of the rigid wall. The rigid wall and the semi-rigid wall can form opposing sides of the bottle. In an embodiment, the semi-rigid wall is not pleated.

In another embodiment, the present disclosure provides an enteral bottle having a body defining a neck and having a rigid wall and a semi-rigid wall. The semi-rigid wall is constructed and arranged to conform to an inner side of the rigid wall in a collapsed form. A cap is attached to the neck. An enteral feeding tube extends from the cap.

In an alternative embodiment, the present disclosure provides a method of supplying a nutritional composition to a patient for non-oral delivery. The method comprises filling a container with the nutritional composition. The container has a rigid wall and a semi-rigid wall. The semi-rigid wall is constructed and arranged to conform to an inner side of the rigid wall in a collapsed form. The method further comprises enterally administering to the patient the nutritional composition through an enteral feeding tube extending from the container.

In yet another embodiment, the present disclosure provides a method of reducing the possibility of contamination of an enteral feeding formulation for delivery to a patient. The method comprises filling an enteral bottle with a nutritional composition. The enteral bottle has a rigid wall and a semi-rigid wall. The semi-rigid wall is constructed and arranged to conform to an inner side of the rigid wall in a collapsed form. The method further comprises enterally administering to the patient the nutritional composition. The semi-rigid wall is constructed and arranged to collapse as the nutritional composition is being administered.

An advantage of the present disclosure is to provide an improved partially collapsible bottle.

Another advantage of the present disclosure is to provide an improved enteral feeding bottle.

Still another advantage of the present disclosure is to provide an improved method of enteral nutrition administration that minimizes contamination.

Yet another advantage of the present disclosure is to provide an improved method of enteral nutrition administration that minimizes the amount of air being administered to a patient.

Additional features and advantages are described herein, and will be apparent from the following Detailed Description and the figures.

DETAILED DESCRIPTION

The present disclosure relates to partially collapsible bottles for providing nutritional compositions and other fluids. The bottles are constructed and arranged to be partially collapsible as the nutritional compositions or fluids are administered from the bottle to an individual or patient. In this regard, the bottles can prevent contaminants and air from entering the bottle during the administration.

As used herein, the term "nutritional composition" includes, but is not limited to, complete nutritional compositions, partial or incomplete nutritional compositions, and disease or condition specific nutritional compositions. A complete nutritional composition (i.e. those which contain all the essential macro and micro nutrients) can be used as a sole source of nutrition for the patient. Patients can receive 100% of their nutritional requirements from such complete nutritional composition. A partial or incomplete nutritional composition does not contain all the essential macro and micro nutrients and cannot be used as a sole source of nutrition for the patient. Partial or incomplete nutritional compositions can be used as a nutritional supplements.

As used herein, the term "Microbe" (or "microbial") refers to an organism that is microscopic (usually too small to be seen by the naked human eye) and include bacteria, fungi, archaea, and protists, as well as some microscopic plants (called green algae) and animals such as plankton, the planarian and the amoeba, viruses, and non-living beings that can cause infection or disease.

A disease or condition specific nutritional composition is a composition that delivers nutrients or pharmaceuticals and can be a complete or partial nutritional composition. Disease or condition specific nutritional compositions are those designed to aid with a given situation, such as Impact® sold by Nestlé Nutrition to decrease post-operative infections, Diabetisource AC® sold by Nestlé Nutrition for people with diabetes or hyperglycemia, and Novasource® Pulmonary sold by Nestlé Nutrition for those patients with pulmonary disease or those requiring ventilator support.

Figure 1:
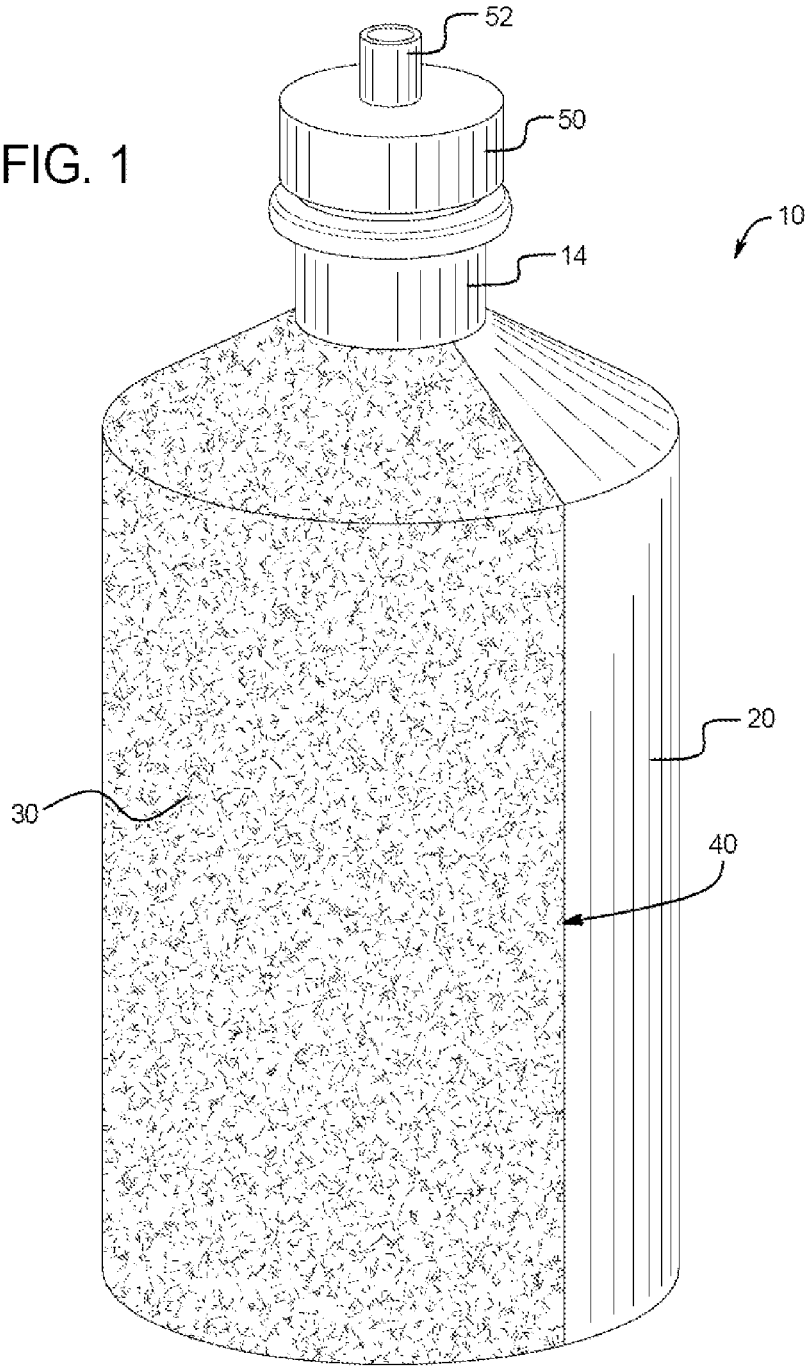
FIG. 1 shows a perspective view of the bottle in one embodiment of the present disclosure.
Figure 2:
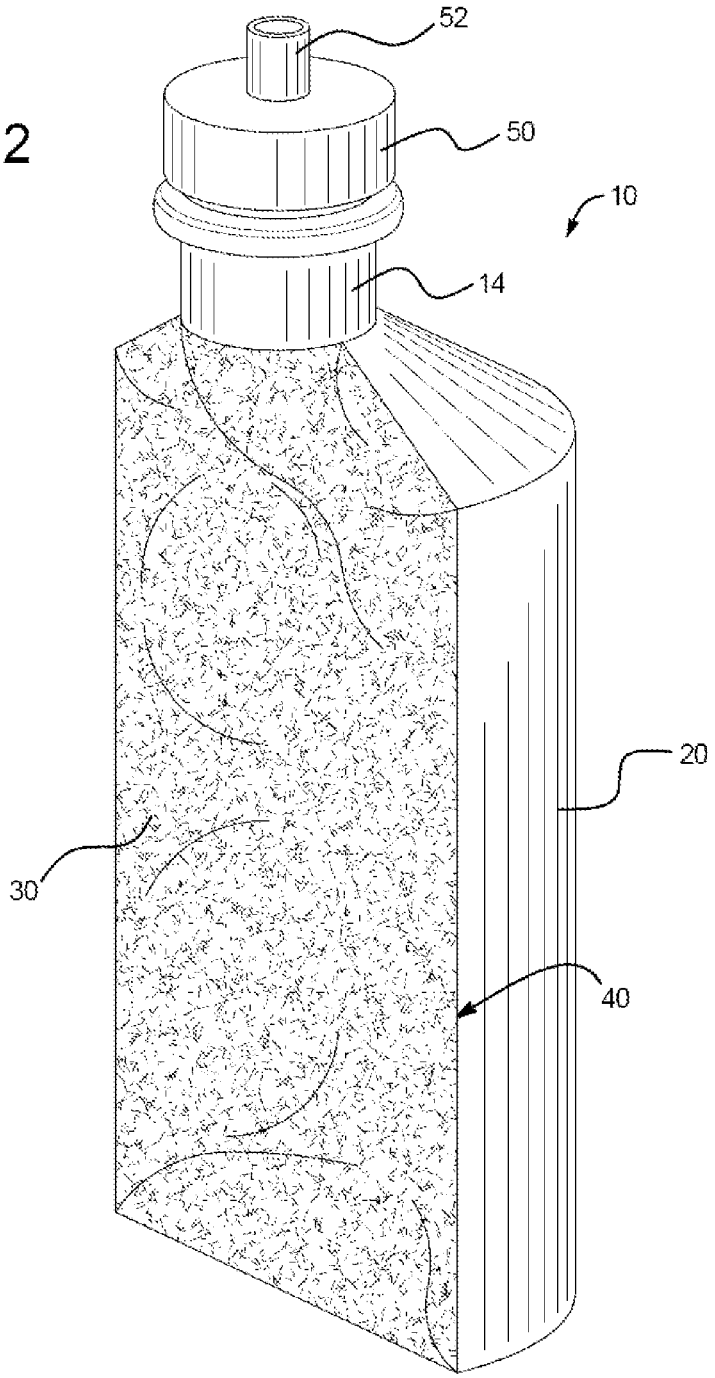
FIG. 2 shows a FIG. 1 shows a perspective view of the bottle in a collapsed form in one embodiment of the present disclosure.

As illustrated in FIGS. 1-2, in an embodiment, the present disclosure provides a bottle 10 having a rigid wall 20 and a semi-rigid wall 30. Semi-rigid wall 30 is constructed and arranged to conform to an inner side 22 of rigid wall 20 in a collapsed form (see FIG. 2). Semi-rigid wall 30 can collapse along its entire surface up to folding line 40, which is the boundary between semi-rigid wall 30 and rigid wall 20. Bottle 10 can have a broad base so as to be able to stand up when the bottle is completely filled, partially filled or empty.

Bottle 10 can further include an air tight cap 50 attached to a neck 14 of bottle 10. Cap 50 can include a upstanding portion 52 that defines a passageway that allows it to be readily connected to a feeding assembly or tube.

As used herein, the term "semi-rigid wall" means a material that is flexible/stretchable and does not resume its original form or position after pressure has been applied to it. As used herein, the term "rigid wall" means a material that is stiff or bending and does resume its original form, or very close to its original form after pressure has been applied to it.

Semi-rigid wall 30 can be constructed and arranged to partially or completely collapse at any desired negative (e.g. suction/vacuum) or positive pressure (e.g. compression) to bottle 10. For example, the pressure can result from a nutritional composition/fluid being removed from bottle 10 during the administration of bottle's 10 contents to a patient. Accordingly, as the nutritional composition/fluid is removed, the vacuum pressure causes semi-rigid wall 30 to collapse so that no air enters the inside of bottle 10. Alternatively, the pressure can result from squeezing or compressing the exterior side of semi-rigid wall 30.

In an embodiment, semi-rigid wall 30 is collapsible upon an applied pressure ranging from about 15 mBar to about 80 mBar. Semi-rigid wall 30 can be collapsible upon an applied pressure ranging from about 40 mBar to about 60 mBar. In addition, semi-rigid wall 30 can be collapsible upon an applied pressure ranging from about 45 mBar to about 55 mBar. Semi-rigid wall 30 can also be collapsible upon an applied pressure of about 50 mBar.

In an embodiment, below neck semi-rigid wall 30 has a surface area greater than or equal to a surface area of rigid wall 20 below neck 14. Rigid wall 20 and semi-rigid wall 30 can form opposing sides of bottle 10. Semi-rigid wall 30 does not need to be pleated to be collapsible. In an embodiment, Semi-rigid wall 30 is not pleated but is collapsible.

Figure 3:
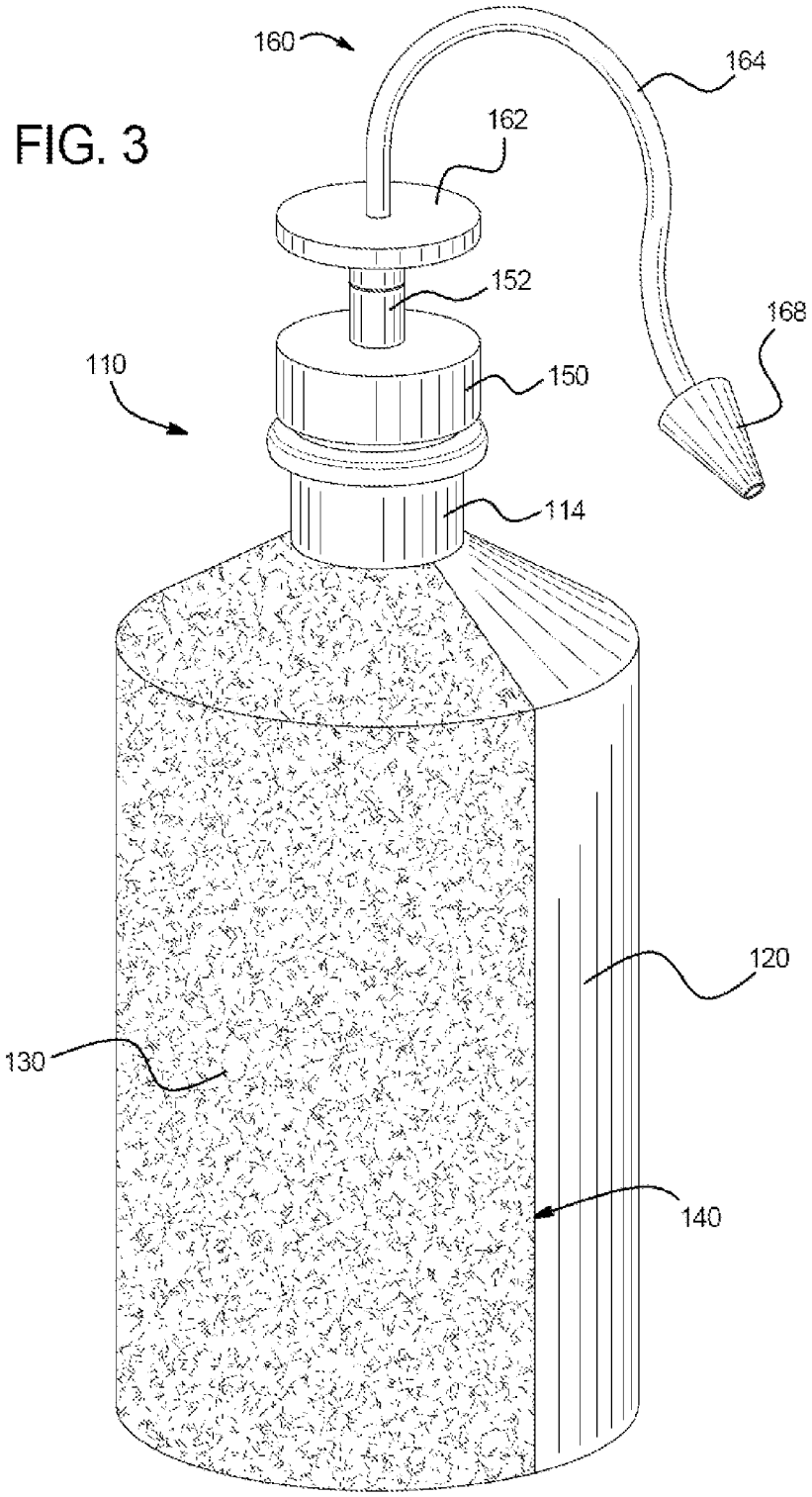
FIG. 3 shows a perspective view of the bottle connected to an administration assembly in one embodiment of the present disclosure.

As illustrated in FIG. 3, in another embodiment, enteral bottle 110 has a body 112 defining a neck 114 and having a rigid wall 120 and a semi-rigid wall 130. Semi-rigid wall 130 is constructed and arranged to conform to an inner side 122 of rigid wall 120 in a collapsed form. Semi-rigid wall 130 can collapse along its entire surface up to folding line 140, which is the boundary between semi-rigid wall 130 and rigid wall 120. Bottle 110 can have a broad base so as to be able to stand up when the bottle is completely filled, partially filled or empty.

Bottle 110 can further include an air tight cap 150 attached to neck 114. Neck 114 can be a wide neck, and cap 150 can be a re-closable threaded cap. Cap 150 can include an upstanding portion 152 that defines a passageway that allows it to be readily connected to a feeding assembly or tube.

An administration assembly 160 can be attached to and extend from upstanding portion 152 of cap 150. Administration assembly 160 can include a gripping surface 162, an enteral feeding tube 164 connected to gripping surface 162, and a patient access tip 168 connected to an end of enteral feeding tube 164. Administration assembly 160 provides a route of travel for any nutritional composition or formula from bottle 110 to a patient when bottle 110 is in use.

The patient access tip 168 can be any suitable patient access termination, tip, or other suitable structure. A person skilled in the art can select an appropriate patient access tip 168 based on various considerations, including the intended point of access in the patient's body, the nature of the formula, and other appropriate considerations. Examples of suitable patient access tips 168 include needles, luer connectors adapted to connect to previously placed needles and other access devices, structures capable of being connected to a previously placed access port in the patient, such as a chest wall port that provides access to the stomach, jejunum and other suitable access ports, and other structures capable of delivering the formula from bottle 110 in an appropriate manner. Also, feeding tubing 164 and patient access tip 168 can be configured as a nasogastric tube, orogastric tube, or in any other suitable configuration.

Bottles 10 and 110 can be sized to hold any suitable volume such as, for example, from about 100 to 5000 mL, and is intended to include all volumes in between, some preferred embodiments including 100 mL, 200 mL, 300 mL, 400 mL, 500 mL, 600 mL, 700 mL, 800 mL, 900 mL, 1000 mL, 1500 mL, 2000 mL, 2500 mL, 3000 mL, 3500 mL, 4000 mL, 4500 mL, 5000 mL and the like.

Semi-rigid walls 30 and 130 and rigid walls 20 and 120 can be made from any suitable partially or completely flexible material such as monolayer or multi-layer films. The monolayer or multi-layer films can be chosen for their cost and their recyclability. The monolayer or multi-layer films can also be chose for their barrier properties.

Suitable materials for the monolayer or multi-layer films can be polyolefin such as, for example, polyethylene ("PE"), low density polyethylene ("LDPE"), high density polyethylene ("HDPE"), polypropylene ("PP") or polyethylene terephthalate ("PET"). The monolayer or multi-layer films can include oxygen barrier materials such as, for example, ethylene vinyl alcohol ("EVOH") and polyamides ("PA") (e.g. nylon, Mxd6). The monolayer or multi-layer films can provide light barriers. They can provide partial or complete barriers to light/UV. For example, the films can be partially opaque. The films can allow the nutritional compositions in the bottle to be seen, but protect light labile and UV sensitive substances.

The partially collapsible bottles in alternative embodiments of the present disclosure can have a ready to hanging mechanism (not shown) attached to any suitable portion of the bottles. The hanging mechanism can be a hook or loop. The bottles can be sold as part of a package that has a hanging mechanism incorporated as part of the package (e.g. part of a package label or around the package).

The partially collapsible bottles can be filled aseptically and contain a better tasting product through the use of a suitable aseptic processing and filling. The bottles can be exposed to a gentle heat treatment or an ultra high temperature. The bottles can be exposed to a retort process (e.g. full bath, steam, continuous, batch).

The partially collapsible bottles can contain and be used to deliver nutritional products for tube and oral feeding, baby formula, condiments, milk and enteral formula. By allowing the bottles to partially collapse during feeding, there is an increased safety as measured by fewer microbial contaminants in its content at 24 hour versus open feeding systems and rigid air vented bottles. This provides health and economic benefits in reducing the number of infections (e.g. needing fewer antibiotics) caused by a contaminated product and reduced days in a hospital.

The shape of the partially collapsible bottles can reduce the risk of being confused with an intravenous ("IV") bag. The bottles provide health and economic benefits, for example, by increasing safety. This can be done by decreasing incidences that result from contamination of the bottle. Such contamination can cause diarrhea and infections in the patient receiving the nutritional compositions in the bottles. Microbial overgrowth in the feeding tubes can be reduced, and feeding tube life can be extended. Less storage space may be needed using the bottles in embodiments of the present disclosure than typical enteral bottles.

During manufacturing, the partially collapsible bottles can provide fewer material seams to seal as compared to other flexible bags (e.g. longitudinal seals, vertical seals, double/triple points). The bottles can be less of a risk for leaking and have easier inspection performed for leaking seals.

In an alternative embodiment, the present disclosure provides a method of supplying a nutritional composition to a patient for non-oral delivery. The method comprises filling a container with the nutritional composition. The container has a rigid wall and a semi-rigid wall. The semi-rigid wall is constructed and arranged to conform to an inner side of the rigid wall in a collapsed form. The method further comprises enterally administering to the patient the nutritional composition through an enteral feeding tube extending from the container.

As used herein, "about," is preferably understood to refer to numbers in a range of numerals. Moreover, all numerical ranges herein should be understood to include all integer, whole or fractions, within the range.

As used herein, "complete nutrition" are preferably nutritional products that contain sufficient types and levels of macronutrients (protein, fats and carbohydrates) and micronutrients to be sufficient to be a sole source of nutrition for the animal to which it is being administered to. Patients can receive 100% of their nutritional requirements from such complete nutritional compositions.

As used herein, "incomplete nutrition" are preferably nutritional products that do not contain sufficient levels of macronutrients (protein, fats and carbohydrates) or micronutrients to be sufficient to be a sole source of nutrition for the animal to which it is being administered to. Partial or incomplete nutritional compositions can be used as a nutritional supplement.

As used herein, "Long term administrations" are preferably continuous administrations for more than 6 weeks.

As used herein, mammal, includes but is not limited to rodents, aquatic mammals, domestic animals such as dogs and cats, farm animals such as sheep, pigs, cows and horses, and humans. Wherein the term mammal is used, it is contemplated that it also applies to other animals that are capable of the effect exhibited or intended to be exhibited by the mammal.

Nutritional products is preferably understood to further include any number of optional additional ingredients, including conventional food additives, for example one or more, acidulants, additional thickeners, buffers or agents for pH adjustment, chelating agents, colorants, emulsifies, excipient, flavor agent, mineral, osmotic agents, a pharmaceutically acceptable carrier, preservatives, stabilizers, sugar, sweeteners, texturizers, and/or vitamin. The optional ingredients can be added in any suitable amount.

As used herein the term "patient" is preferably understood to include an animal, especially a mammal, and more especially a human that is receiving or intended to receive treatment, as it is herein defined.

As used in this specification and the appended claims, the singular forms "a", "an" and "the" include plural referents unless the context clearly dictates otherwise. Thus, for example, reference to "a polypeptide" includes a mixture of two or more polypeptides, and the like.

All dosage ranges contained within this application are intended to include all numbers, whole or fractions, contained within said range.

As used herein, "Short term administrations" are preferably continuous administrations for less than 6 weeks.

As used herein, a "tube feed" is preferably a complete or incomplete nutritional products that are administered to an animal's gastrointestinal system, other than through oral administration, including but not limited to a nasogastric tube, orogastric tube, gastric tube, jejunostomy tube (J-tube), percutaneous endoscopic gastrostomy (PEG), port, such as a chest wall port that provides access to the stomach, jejunum and other suitable access ports.

In yet another embodiment, the present disclosure provides a method of reducing the possibility of contamination of an enteral feeding formulation for delivery to a patient. The method comprises filling an enteral bottle with a nutritional composition. The enteral bottle has a rigid wall and a semi-rigid wall. The semi-rigid wall is constructed and arranged to conform to an inner side of the rigid wall in a collapsed form. The method further comprises enterally administering to the patient the nutritional composition. The semi-rigid wall is constructed and arranged to collapse as the nutritional composition is being administered.

Administering the nutritional composition or enteral feeding formulation using the partially collapsible bottles can improve the ease of use as measured by less nursing time required to prepare tube feeding versus conventional rigid bottles having open systems (e.g. air is allowed to flow into the bottle as the formula is dispensed). The partially collapsible bottles are easier to handle and require less nursing manipulations than typical rigid air vented bottles, which might having clogging of the air vent during use.

The partially collapsible bottles in alternative embodiments of the present disclosure provide flexible usage because the non-air dependent system allows for both tube and oral feeding. The bottles in an embodiment can provide an easy administration set connection for tube feeding via pump or gravity method.

The partially collapsible bottles in an embodiment can provide lower environmental and waste impact. For example, the partially collapsible bottles in an embodiment can be constructed to have a lower $CO_2$ footprint than retorted glass and plastic rigid bottles. The partially collapsible bottles in an embodiment can be constructed to have a lower $CO_2$ footprint than retorted flexible bags. The partially collapsible bottles in an embodiment can be constructed to use less plastic material than the rigid plastic bottle. The partially collapsible bottles in an embodiment can be constructed to use less disposal volume than rigid plastic bottles.

The partially collapsible bottles can be made using any suitable manufacturing process such as, for example, conventional extrusion blow molding, stretch blow molding (1 stage & 2 stage) or injection stretch blow molding.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A bottle comprising:

a rigid wall; and a semi-rigid wall, the semi-rigid wall being so constructed and arranged to conform to an inner side of the rigid wall in a collapsed form, the rigid and semi-rigid walls having the same shape, and the semi-rigid wall being collapsible upon the application of a pressure of from about 15 mBar to about 80 mBar and comprises a surface area greater than a surface area of the rigid wall;

a neck formed from the rigid wall;

an air tight cap attached to the neck, the air tight cap including a passageway configured to be connected to a feeding assembly or tube, the neck and the air tight cap defining a longitudinal axis, and the semi-rigid wall so constructed and arranged to collapse along a direction substantially perpendicular to the longitudinal axis; and a base, and the bottle has a volume ranging from about 100 to 5000 mL.

2. The bottle of claim 1 comprising a bottle for an enteral feed.

3. The bottle of claim 1, wherein the semi-rigid wall is collapsible upon the application of a pressure of from about 40 mBar to about 60 mBar.

4. The bottle of claim 1, wherein the semi-rigid wall is collapsible upon the application of a pressure of from about 45 mBar to about 55 mBar.

5. The bottle of claim 1 comprising a material selected from the group consisting of at least one active barrier material, at least one passive barrier material, and at least one active barrier material and at least one passive barrier material.

6. The bottle of claim 1 comprising a hanging mechanism.

7. The bottle of claim 1, wherein the walls are made of at least one material selected from the group consisting of monolayer material, one multi-layer material, and a combination of monolayer and multilayer materials.

8. The bottle of claim 1 comprising an enteral feeding tube extending from the cap.

9. A method of supplying a nutritional composition to a patient for non-oral delivery, the method comprising:

filling a bottle with a nutritional composition, the bottle comprising a rigid wall and a semi-rigid wall, a neck formed from the rigid wall, an air tight cap attached to the neck, and a base, the air tight cap including a passageway configured to be connected to a feeding assembly or tube, the semi-rigid wall so constructed and arranged to conform to an inner side of the rigid wall in a collapsed form, the rigid and semi-rigid walls having the same shape, and the semi-rigid wall being collapsible upon the application of a pressure of from about 15 mBar to about 80 mBar and comprising a surface area greater than a surface area of the rigid wall, the neck and the air tight cap defining a longitudinal axis, and the semi-rigid wall so constructed and arranged to collapse along a direction substantially perpendicular to the longitudinal axis; and enterally administering to the patient the nutritional composition through an enteral feeding tube extending from the bottle.

10. The method of claim 9, wherein the patient is a mammal.

11. The method of claim 9, wherein the patient is a human.

12. The method of claim 9, wherein the semi-rigid wall collapses as the nutritional composition is administered.

13. A method of reducing healthcare costs, the method comprising:

administering an enteral feeding solution to a patient using a bottle comprising a rigid wall and a semi-rigid wall, a neck formed from the rigid wall, an air tight cap attached to the neck, and a base, the air tight cap including a passageway configured to be connected to a feeding assembly or tube, the semi-rigid wall so constructed and arranged to conform to an inner side of the rigid wall in a collapsed form, the rigid and semi-rigid walls having the same shape, and the semi-rigid wall being collapsible upon the application of a pressure of from about 15 mBar to about 80 mBar and comprising a surface area greater than a surface area of the rigid wall, the neck and the air tight cap defining a longitudinal axis, and the semi-rigid wall so constructed and arranged to collapse along a direction substantially perpendicular to the longitudinal axis, wherein using of the bottle reduces healthcare costs by decreasing contamination of the enteral feeding solution as compared with enteral feeding solutions that use another different bottle.

14. The method of claim 13, wherein the reduction in healthcare cost is due to a decreased incidence of microbial infection.

15. The method of claim 13, wherein the reduction in healthcare cost is due to a reduction of antibiotic used to treat a disorder selected from the group consisting of fungal infections (thrush), urinary tract infections, *C. difficile* associated diarrhea and combinations thereof.

16. The method of claim 15, wherein the reduction in healthcare cost is due to a reduction of sequellae from antibiotic used to treat a disorder selected from the group consisting of fungal infections (thrush), urinary tract infections, *C. difficile* associated diarrhea, antibiotic resistant bacteria, methicillin-resistant *Staphylococcus aureus*, and combinations thereof.

17. The method of claim 13, wherein the reduction in healthcare cost is due to increased hang time of the enteral solution.

18. The method of claim 13, wherein the reduction in healthcare cost is due to a reduction in clogging of the enteral tubes.

19. The method of claim 13, wherein the reduction in healthcare cost is due to a saving of nurse's time.

20. The method of claim 13, wherein the reduction in healthcare cost is due to a reduction in number of alarms from the enteral feeding pump compared with when other bottles are used.

21. The method of claim 13, wherein the reduction in healthcare cost is due to reducing environmental impact/waste costs the reduction being due to a lower carbon footprint as compared with other bottles due to less material used in the manufacture of the bottle compared to other bottles.

22. The method of claim 13, wherein the reduction in healthcare cost is due to reducing environmental impact/waste costs the reduction being due to a lower carbon footprint as compared with other bottles due to less disposal volume compared to other bottles.

* * * * *